United States Patent [19]

Stahlecker

[11] Patent Number: 4,817,815

[45] Date of Patent: Apr. 4, 1989

[54] CONTAINER COMPRISING CYLINDRICAL JACKET AND LID WITH CLOSABLE VENT AND PROCESS FOR ITS PRODUCTION

[75] Inventor: Peter Stahlecker, Matthews, N.C.

[73] Assignee: American Suessen Corporation, Charlotte, N.C.

[21] Appl. No.: 177,992

[22] Filed: Apr. 5, 1988

[30] Foreign Application Priority Data

May 6, 1987 [DE] Fed. Rep. of Germany ..... 3714949

[51] Int. Cl.[4] ..... B65D 39/04; B65D 51/18

[52] U.S. Cl. ..... 220/209; 53/478; 53/489; 220/254; 220/359; 220/360; 220/367

[58] Field of Search ..... 53/403, 478, 489; 220/254, 256, 258, 266, 355, 359, 360, 363–365, 367, 203, 209

[56] References Cited

U.S. PATENT DOCUMENTS

| | | | |
|---|---|---|---|
| 3,312,368 | 4/1967 | Reynolds et al. | 220/367 |
| 3,419,181 | 12/1968 | Stec | 220/258 |
| 3,432,087 | 3/1969 | Costello | 220/367 |
| 3,717,276 | 2/1973 | Luczak et al. | 220/367 |
| 4,405,056 | 9/1983 | Patterson | 220/258 |
| 4,650,088 | 3/1987 | Hirota et al. | 220/359 |
| 4,653,661 | 3/1987 | Buchner et al. | 220/367 |
| 4,689,936 | 9/1987 | Gaikema et al. | 53/478 |

FOREIGN PATENT DOCUMENTS

| | | | |
|---|---|---|---|
| 0208352 | 1/1987 | European Pat. Off. . | |
| 2341414 | 2/1975 | Fed. Rep. of Germany | 220/364 |
| 3023835 | 1/1981 | Fed. Rep. of Germany . | |
| 1187305 | 9/1959 | France | 220/44 R |

*Primary Examiner*—Jimmy G. Foster

*Attorney, Agent, or Firm*—Burns, Doane, Swecker & Mathis

[57] ABSTRACT

A sealed container comprises a cylindrical jacket closed at opposite ends by closure pieces welded to the jacket. One closure piece forms a lid having an outlet opening pre-sealed by a tear-off tab. The lid includes a skirt projecting into the jacket, and a gas vent opening which is open during the installation of the closure pieces to vent displaced gas, and is thereafter closed by securing an end of the tear-off tab thereover, or by deforming the lid material, or by placing a drop of hardenable plastic in the vent opening.

13 Claims, 4 Drawing Sheets

CONTAINER COMPRISING CYLINDRICAL JACKET AND LID WITH CLOSABLE VENT AND PROCESS FOR ITS PRODUCTION

BACKGROUND OF THE INVENTION

The invention concerns a process for the production of a sealed container comprising a plastic or paper jacket closed off at both ends by plastic closure pieces, one of which pieces contain a tear-off tab.

A container of this type and process for its production are known from German DE-OS No. 30 23 835. The cylindrical jacket is coated at least on the inside with a plastic coating. One of the closure pieces serves as a lid and is provided with an outlet opening and a tear-off tab closing the outlet opening. One of the closure pieces contains a cylindrical projection which is pressed into the jacket and welded or otherwise sealed to the jacket.

In the cylindrical jacket made of coated paper, a disk shaped bottom is attached to an inward flanging of the lower edge of the container jacket, and a similarly disk-shaped lid is attached to the top of the jacket by flanging its outer edge around the top edge of the jacket. The lid is provided with an opening, as known for example from containers for fruit juice or milk beverages, which initially is closed tightly by a sealed tear-off tab. After the tab is torn off, the contents of the container become accessible and may be poured out or removed by the insertion of a straw.

Containers of that type have the disadvantage of a relatively low stability. Another disadvantage is that if the lid contains an extension to be pushed tightly into the container jacket by means of sealing jaws under the effect of heat, the venting of displaced air from the jacket becomes difficult.

It is known (see European Document No. 02 08 352-A1) that a container whose contents are to be subjected later to a heat treatment (for example to be sterilized) may be provided with a bellows-like center part which undergoes thermal expansions together with the air in the container. It is also known from this prior art to provide an opening in the center of the bellows-like projection. That opening is closed by a drop of plastic, which is still liquid at the temperature of the heat treatment and which solidifies only upon the cooling of the container. This expedient is intended to ensure that the volume of air increased by the heating phase is able to leave through the opening. Subsequently, the deformable center part equalizes the temperature. For closed containers of the type containing an outlet opening with a tear-off tab, such a lid is not feasible. In those containers the tear-off tab must as a rule be tightly sealed prior to the application of the lid, as otherwise it is not possible to thereafter join the tear-off tab tightly enough to the lid under the effect of heat and pressure due to a lack of strength of the lid.

An object of the present invention is to eliminate the disadvantage that the air cannot escape from containers of this type during the installation of the closure pieces.

SUMMARY OF THE INVENTION

To attain this object, the invention involves the provision of a small vent opening in a radially outer area of one of the closure pieces, with the vent opening being closed tightly only following the pressure-insertion and sealing of the closure pieces. This makes possible the escape of air displaced by the forced insertion of the lid or bottom and of the thermally expanded air resulting from the welding of the lid or the bottom. The location of the vent opening in the outer area where the container is most rigid makes it possible to subsequently close the vent opening by the application of sealing tools or the like. The sealing may be effected either by means of an extended part of the tear-off tab itself, which then is sealed against the lid, or by equipping the vent opening with a squeeze border which subsequently is compressed, or by inserting a drop of molten plastic into the vent opening.

THE DRAWINGS

The objects and advantages of the invention will become apparent from the following detailed description of preferred embodiments thereof in connection with the accompanying drawings, in which like numerals designate like elements, and in which.

DETAILED DESCRIPTION OF PREFERRED EMBODIMENTS OF THE INVENTION

Figure 1:
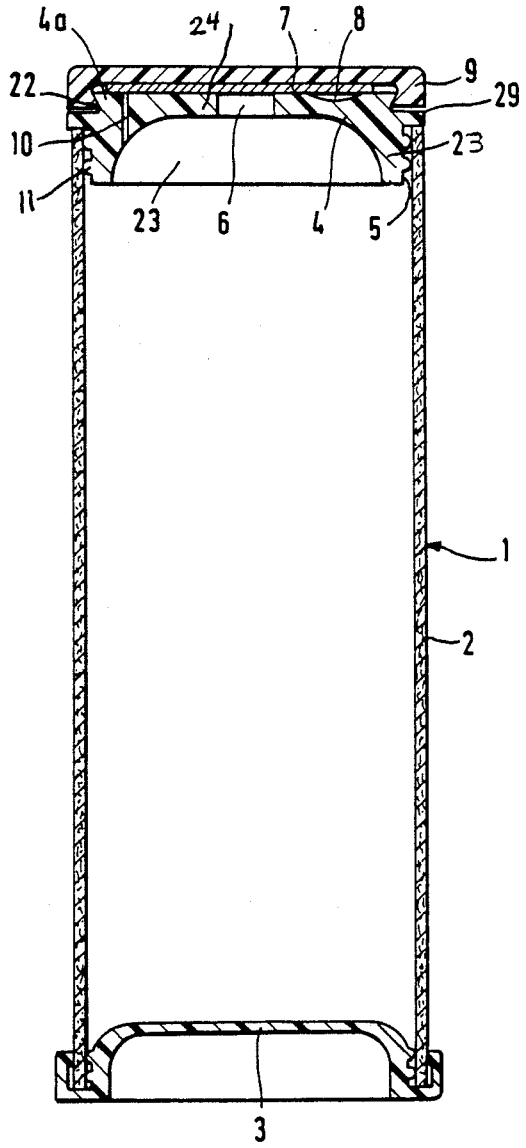
FIG. 1 is a longitudinal sectional view through a container produced by the process according to the invention.

The container according to FIG. 1 comprises a jacket 2 formed of wound cardboard. The cardboard is coated on both sides by a plastic that is liquid-tight and able to form a weld or adhesive seal. The end edges of the jacket may be sealed against the penetration of liquids in any known manner. It is possible alternatively to make the container jacket entirely of plastic rather than cardboard to eliminate the need for plastic coatings.

A plastic bottom 3 is set into the container jacket 2 and is joined thereto by welding in a conventional manner. Following the filling of the container jacket 1 with a beverage or the like, a plastic closure piece 4 defining a lid is set upon the jacket. The lid 4 includes a disk portion 24 and a cylindrical skirt or extension 23 projecting into the jacket 1. In the outer periphery 5 of the extension 23 are formed sealing lips in the form of ribs 11 enabling the plastic lid 4 to be welded to the jacket 2. Entry of the lid into the jacket is limited by a laterally projecting rim 29 of the lid which abuts against the end edge of the jacket.

The plastic lid 4 has an outlet opening 6 which is closed by a tear-off tab 7 prior to the placing of the lid 4 on the jacket. The plastic lid 4 may include a recess 8 enabling the tear-off tab 7 to be gripped to uncover the outlet opening.

The plastic lid 4 is optionally covered with a snap-on cap 9. In such a case, the upper part 4*a* of the plastic lid 4 would be provided with a peripheral annular groove 22 of dove-tail shape enabling the cap 9 to be snapped onto the lid.

To make possible the escape of air during the insertion and welding of the plastic lid 4 to the container jacket 2, as the plastic lid 4 is pressed in an air tight manner into the container 1, an air vent opening 10 is provided in the lid. This opening 10 will be closed only after the plastic lid 4 has been welded or glued to the container jacket 1.

Figure 2:
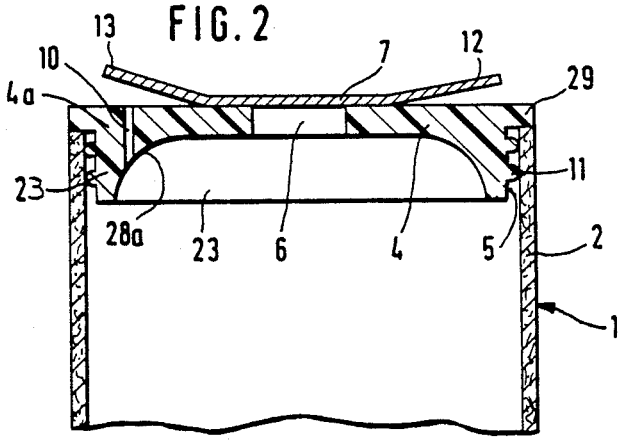
FIG. 2 depicts the upper area of the container of FIG. 1 prior to the closing of the vent opening.

In FIG. 2 the upper area of the container 1 of FIG. 1 is shown, with the cap 9 not yet set on the container and the groove 22 eliminated.

FIG. 2 shows the instant of the welding of the plastic lid 4 to the container jacket 2, with the air vent opening 10 not yet closed. The outlet opening 6 has already been tightly closed by the tear-off tab 7. The tear-off tab 7 had been sealed in place earlier under the effect of pressure and heat. Sealing the tear-off tab 7 after placing the lid on the jacket would not have been possible due to the pressure forces needed to be applied to the tab 7. That is, adequate resistance to such forces could not have been achieved. An end of the tab forms a gripping tongue 12 which is slightly raised from the plastic lid 4 so that it may be gripped manually.

The ribs 11 of the plastic lid 4 rest against the inside surface of the container jacket 2. No air can escape past those ribs during the insertion and welding of the plastic lid 4 to the container jacket 2. Disadvantageous consequences which would otherwise occur as a result of such inability of air to escape are avoided in accordance with the present invention, because air displaced by the insertion of the extension 23 and subsequent thermal expansion of the air may escape through the vent opening 10.

Figure 3:
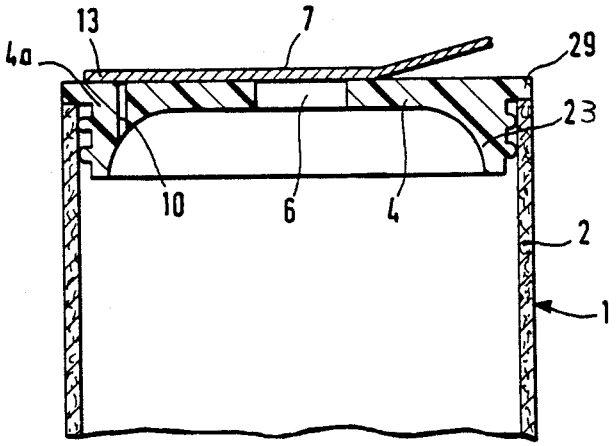
FIG. 3 is a view similar to FIG. 2 after the closing of the vent opening.

As can be seen in FIG. 3, the vent opening 10 has thereafter been closed by placing an end 13 of the tear-off tab 7 over the vent opening 10 and sealing it to the plastic lid 4. The container jacket 1 is thereby sealed hermetically from the outside. The vent opening 10 is located in the area of the skirt 23 of the lid 4 which is able to withstand forces pushing the end 13 of the tear-off tab 7 against the lid. In other words, by locating the vent closer to the radially outer portion of the lid, e.g., directly in the skirt or cupola-shaped transition region 28*a* between the disk portion and skirt (which transition region is thicker than the disk portion), the forces applied to the lid when sealing the vent can be more readily resisted.

Figure 4:
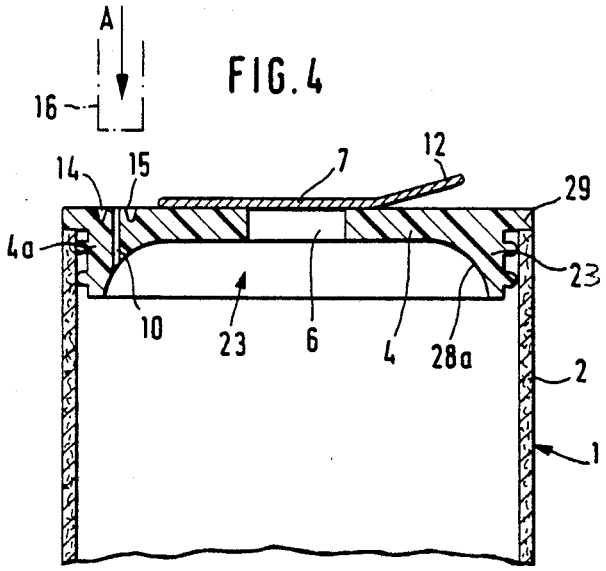
FIG. 4 is a view similar to FIG. 2 of a second embodiment, wherein the vent opening may be closed by means of a heated die.
Figure 5:
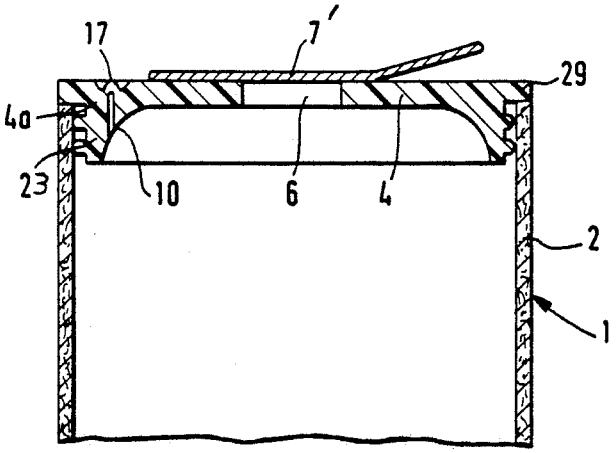
FIG. 5 is a view of the FIG. 4 embodiment following the closing of the vent opening.

FIGS. 4 and 5 show a modified embodiment wherein, again, the outlet opening 6 of the plastic lid 4 is closed by a tear-off tab 7′ prior to the welding f the latter into the container jacket 2. However, the tear-off tab 7′ does not extend to the vent opening 10. Rather, the outer end of the vent opening 10 is provided with a rib-like border 15, around which an annular recess 14 is located. If a heated die 16, indicated by a dash-and-dot line is pressed against the border 15 in the direction of the arrow A, the vent opening 10 will be pressed shut by the formation of a bead 17, as shown in FIG. 5.

Figure 6:
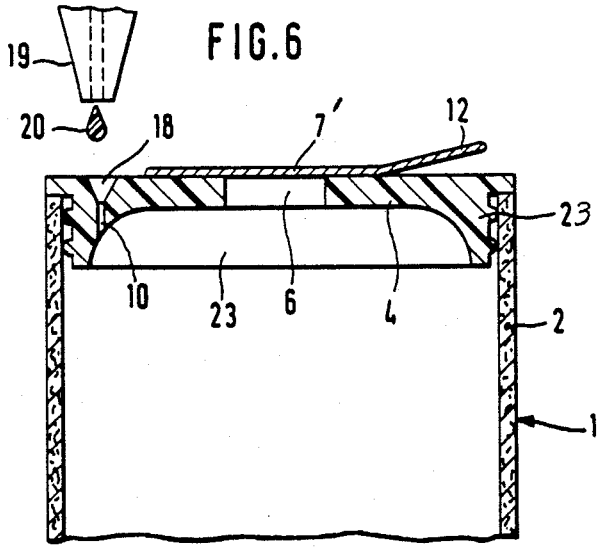
FIG. 6 is a view similar to FIG. 2 of a third embodiment wherein the vent opening is closed by means of a plasticized drop of plastic.
Figure 7:
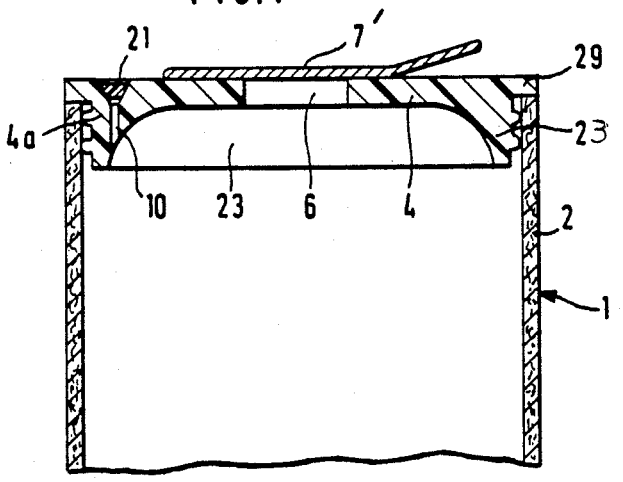
FIG. 7 is a view of the embodiment of FIG. 6 following the closing of the vent opening.

In a further modified embodiment according to FIGS. 6 and 7, the outer end of the vent opening 10 is provided with a funnel-shaped inlet 18 which expands outwardly. By means of a nozzle 19, a plasticized drop 20 of plastic is introduced into the vent inlet 18. As seen in FIG. 7, this creates a plug 21 settled in the funnel-shaped inlet 18 and which thereby has closed the vent opening 10 after the welding of the plastic lid 4 to the container 1.

In yet another embodiment (not shown) the vent opening 10 could be located in the container bottom 3. The vent opening 10 is then appropriately closed by one of the methods described in connection with FIGS. 4 to 7.

Although the present invention has been described in connection with preferred embodiments thereof, it will be appreciated by those skilled in the art that modifications, substitutions and deletions not specifically described may be made without departing from the spirit and scope of the invention as defined in the appended claims.

What is claimed is:

1. A process for the production of a sealed container comprising the steps of:

providing a cylindrical jacket of plastic material or of paper coated with plastic at least on an inside cylindrical surface thereof, closing-off opposite ends of said jacket by installing first and second plastic closure pieces at said ends, respectively, one of said first and second closure pieces defining a lid having an outlet opening closed by a tear-off tab prior to installation thereof to said jacket, said closing-off step including installing a cylindrical projection of one of said first and second closure pieces into said jacket in a manner forming a seal therebetween, one of said first and second closure pieces including a gas vent opening located in a radially outer portion thereof, which vent opening is sealed only after the installation of both of said first and second closure pieces.

2. Process according to claim 1, wherein said one of said first and second closure pieces in which said vent opening is formed comprises said lid, said vent opening being closed by a portion of said tear-off tab.

3. Process according to claim 2, wherein said portion of said tear-off tab is raised from said vent opening during installation of said lid and is thereafter pressed down over said vent opening and sealed to said lid under the effect of pressure and heat.

4. Process according to claim 1, wherein an outer end of said vent opening is surrounded by an annular border which is tightly deformed to close said vent opening.

5. Process according to claim 1, wherein an outer end of said vent opening is widened in an outward direction and is closed by inserting thereinto a drop of molten plastic material which thereafter solidifies.

6. Process according to claim 1, wherein said one of said firs and second closure pieces in which said vent opening is formed comprises said closure piece containing said projection.

7. Process according to claim 6, wherein said one of said first and second closure pieces containing said projection comprises said lid.

8. A sealed container comprising:

a cylindrical jacket of plastic material or of paper material coated with plastic at least on an inner cylindrical surface thereof, and first and second plastic closure pieces closing-off opposite ends of said jacket, one of said first and second closure pieces defining a lid having an outlet opening pre-closed by a tear-off tab, one of said first and second closure pieces including an outer cylindrical skirt extending into said jacket and sealed relative thereto, one of said first and second closure pieces including a gas vent opening closed-off at its outer end, said gas vent opening located in a radially outer portion of said last-named closure piece, said gas vent opening being closed only after both said closure pieces are installed on said jacket.

9. A container according to claim 8, wherein said closure piece containing said skirt includes a disk portion, said skirt projecting from an outer periphery of said disk portion and forming a cupola-shaped transition region therewith.

10. A container according to claim 8, wherein said closure piece containing said skirt includes a laterally projecting rim abutting an end edge of said jacket.

11. A container according to claim 8, wherein said vent opening is closed by a portion of said tear-off tab.

12. A container according to claim 8, wherein said outer end of said vent opening is closed-off by a deformation of said closure piece.

13. A container according to claim 8, wherein said outer end of said vent opening comprises an outwardly widening portion, said vent opening being closed-off by a drop of hardened plastic disposed in said outwardly widening portion.

* * * * *